US011820136B2

(12) United States Patent
Oikawa et al.

(10) Patent No.: US 11,820,136 B2
(45) **Date of Patent: *Nov. 21, 2023**

(54) PRINTING APPARATUS AND METHOD OF CONTROLLING SAME

(71) Applicant: CANON KABUSHIKI KAISHA, Tokyo (JP)

(72) Inventors: Yuhei Oikawa, Yokohama (JP); Yutaka Kano, Kawasaki (JP); Kohei Sato, Yokohama (JP); Takuya Fukasawa, Yokohama (JP)

(73) Assignee: Canon Kabushiki Kasiha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/533,777

(22) Filed: Nov. 23, 2021

(65) Prior Publication Data

US 2022/0153017 A1 May 19, 2022

Related U.S. Application Data

(63) Continuation of application No. 16/590,454, filed on Oct. 2, 2019, now Pat. No. 11,192,357.

(30) Foreign Application Priority Data

Oct. 5, 2018 (JP) ..... 2018-190314

(51) Int. Cl.
*B41J 2/045* (2006.01)

(52) U.S. Cl.
CPC ..... *B41J 2/0451* (2013.01); *B41J 2/0458* (2013.01); *B41J 2/04563* (2013.01)

(58) Field of Classification Search
CPC ..... B41J 2/0451; B41J 2/0458; B41J 2/04563
See application file for complete search history.

(56) References Cited

U.S. PATENT DOCUMENTS

| | | | |
|---|---|---|---|
| 7,806,503 | B2 | 10/2010 | Aoki et al. |
| 8,186,798 | B2 | 5/2012 | Aoki et al. |
| 8,628,163 | B2 | 1/2014 | Kanematsu et al. |
| 9,409,390 | B1 | 8/2016 | Nishikori et al. |
| 2019/0299590 | A1 | 10/2019 | Oikawa et al. |
| 2019/0299601 | A1 | 10/2019 | Oikawa et al. |

FOREIGN PATENT DOCUMENTS

| | | | |
|---|---|---|---|
| JP | 2008-000914 | A | 1/2008 |

*Primary Examiner* — Lam S Nguyen
(74) *Attorney, Agent, or Firm* — Venable LLP

(57) ABSTRACT

Although a conventional method of inspecting an ink discharge state in which the temperature change of the heater is detected enables accurate and high-speed inspection, due to the situation in which the inspection was performed, appropriate post-processing depending on the situation cannot be executed based on a result of the inspection. Therefore, it is necessary to determine the ink discharge state in detail. A plurality of modes are provided in accordance with the purpose of performing an inspection of the ink discharge state, and a discharge inspection threshold is provided for each of these modes. By selectively executing or continuously executing these modes, it is possible to determine the ink discharge state in more detail.

35 Claims, 11 Drawing Sheets

| NOZZLE No. | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| DETERMINATION RESULT SIGNAL RSLT | 1 | 1 | 0 | 0 | 1 | 1 | 1 | 0 | 1 | 0 | 1 | 1 | 0 | 0 | 0 | 1 |

1 : NORMAL DISCHARGE
0 : DISCHARGE FAILURE OR NON-DISCHARGE

| NOZZLE No. | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| DETERMINATION RESULT SIGNAL RSLT | 1 | 1 | 1 | 0 | 1 | 1 | 1 | 1 | 1 | 1 | 1 | 1 | 0 | 0 | 0 | 1 |

1 : NORMAL DISCHARGE OR DISCHARGE FAILURE
0 : NON-DISCHARGE

DETERMINATION RESULT SIGNAL RSLT

| NOZZLE No. | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 1st DISCHARGE INSPECTION MODE | 1 | 1 | 0 | 0 | 1 | 1 | 1 | 0 | 1 | 0 | 1 | 1 | 0 | 0 | 0 | 1 |
| 2nd DISCHARGE INSPECTION MODE | 1 | 1 | 1 | 0 | 1 | 1 | 1 | 1 | 1 | 1 | 1 | 1 | 0 | 0 | 0 | 1 |

| 1st DISCHARGE INSPECTION MODE | 2nd DISCHARGE INSPECTION MODE | DISCHARGE STATE |
|---|---|---|
| 1 | 1 | NORMAL DISCHARGE |
| 0 | 1 | DISCHARGE FAILURE |
| 0 | 0 | NON-DISCHARGE |

PRINTING APPARATUS AND METHOD OF CONTROLLING SAME

BACKGROUND OF THE INVENTION

Field of the Invention

The present invention relates to a printing apparatus and a method of controlling the same, and particularly to, for example, a printing apparatus adapted to a printhead incorporating an element substrate equipped with a plurality of print elements in order to perform printing according to an inkjet method, and a method of controlling the same.

Description of the Related Art

Among ink-jet printing methods for causing ink droplets to be discharged from nozzles and adhere to a print medium such as paper, a plastic film, or the like, there is a method that uses a printhead having a print element for generating thermal energy in order to discharge ink. For a printhead according to this method, it is possible to form, for example, an electrothermal transducer which generates heat in response to energization and a driving circuit thereof, and the like using a process that is similar to a semiconductor manufacturing process. Therefore, there are advantages such as it being easy to implement nozzles at a high density, and high definition printing can be achieved being achievable.

In such a printhead, ink discharge failure may occur in some or all of the nozzles of the printhead due to, for example, clogging of the nozzles in accordance with ink with increased viscosity or a foreign substance, air bubbles mixed in an ink supply channel or nozzles, or change in the wettability of a nozzle surface. In order to avoid deterioration of image quality that occurs when such a discharge failure occurs, it is preferable to quickly execute a recovery operation for recovering an ink discharge state or a complementary operation by another nozzle or the like. However, an extremely important problem is to accurately and timely determine the ink discharge state and the occurrence of discharge failure in order to quickly perform these operations.

In view of such a background, various ink discharge state determination methods, complementary printing methods, and apparatuses to which these methods are applied have been conventionally proposed.

Japanese Patent Laid-Open No. 2008-000914 discloses a method of detecting a temperature drop occurring at the time of normal discharge in order to detect an ink discharge failure from a printhead. According to Japanese Patent Laid-Open No. 2008-000914, at a time of normal discharge, a point (feature point) at which a temperature drop rate changes after a predetermined amount of time from a time when a detected temperature reaches a maximum temperature appears, but this point does not appear at a time of discharge failure. Therefore, the ink discharge state is determined by detecting the presence or absence of this feature point. Japanese Patent Laid-Open No. 2008-000914 also discloses a configuration in which a temperature detection element is provided directly under a print element which causes ink discharge thermal energy to be generated, and, as a method of detecting the presence or absence of the above-described feature point, a method of detecting the feature point as a peak value in accordance with differential processing of temperature change.

The method of determining the discharge state disclosed in Japanese Patent Laid-Open No. 2008-000914 can distinguish between a normal discharge state and a discharge failure state accurately and at high speed. However, in the above-mentioned conventional example, since, depending on the situation in which a discharge inspection is performed, it is not possible to detect nozzles in a discharge failure state by merely distinguishing between the two states of normal discharge and discharge failure, there have been cases in which appropriate processing according to the situation cannot be executed.

SUMMARY OF THE INVENTION

Accordingly, the present invention is conceived as a response to the above-described disadvantages of the conventional art.

For example, a printing apparatus and a method of controlling the same according to this invention are capable of determining an ink discharge state in more detail.

According to one aspect of the present invention, there is provided a printing apparatus comprising: a printhead provided with a plurality of nozzles for discharging ink, a plurality of heaters, provided in each of the plurality of nozzles, for heating ink, a plurality of temperature detection elements provided in correspondence with each of the plurality of heaters, and an inspection portion for inspecting ink discharge states of the plurality of nozzles using the plurality of temperature detection elements; an inspection unit configured to cause the printhead to inspect an ink discharge state after selecting a nozzle to be a target for inspecting the ink discharge state from the plurality of nozzles provided in the printhead, and setting a threshold for determining a discharge state of the selected nozzle; and a control unit configured to perform at least one of a first mode in which a first threshold is set as the threshold and an inspection is performed by the inspection unit at a first timing, and a second mode in which a second threshold value different from the first threshold value is set as the threshold value and an inspection is performed by the inspection unit at a second timing different from the first timing.

According to another aspect of the present invention, there is provided a method of controlling a printing apparatus operable to print on a print medium using a printhead provided with a plurality of nozzles for discharging ink, a plurality of heaters, provided in each of the plurality of nozzles, for heating ink, a plurality of temperature detection elements provided in correspondence with each of the plurality of heaters, and an inspection portion for inspecting ink discharge states of the plurality of nozzles using the plurality of temperature detection elements, the method comprising: selecting, from the plurality of nozzles provided in the printhead, a nozzle to set as a target for inspecting an ink discharge state; setting a threshold for inspection of the selected nozzle, and causing the printhead to inspect an ink discharge state; and performing at least one of a first mode in which a first threshold is set as the threshold and an inspection is performed at a first timing, and a second mode in which a second threshold value different from the first threshold value is set as the threshold value and an inspection is performed at a second timing different from the first timing.

The invention is particularly advantageous since the discharge state of each nozzle can be distinguished in more detail, and it is possible to select appropriate processing in accordance with a result of this distinguishing. This makes it possible to reduce the time required for processing and to reduce wasteful ink consumption.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, unless otherwise specified, and a "print element" is provided in correspondence to an orifice, and means an element for generating energy used to discharge ink. For example, the print element may be provided in a position opposing to the orifice.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing Apparatus Mounted with Full-Line Printhead (FIG. 1)>

Figure 1:
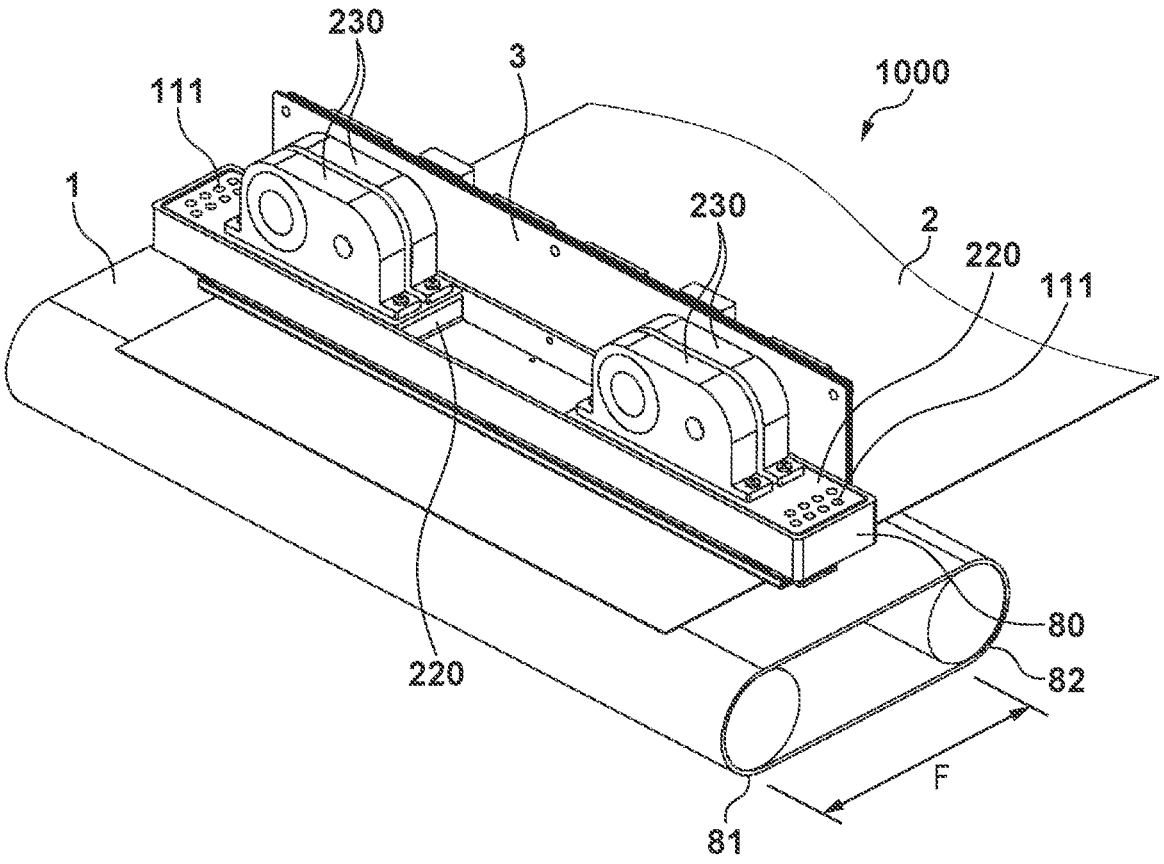
FIG. 1 is a perspective view for describing the structure of a printing apparatus equipped with a full-line printhead, which is an exemplary embodiment of the present invention.

FIG. 1 is a perspective view showing the schematic arrangement of a printing apparatus 1000 using a full-line printhead that performs printing by discharging ink according to an exemplary embodiment of the present invention.

As shown in FIG. 1, the printing apparatus 1000 is a line type printing apparatus that includes a conveyance unit 1 that conveys a print medium 2 and a full-line printhead 3 arranged to be approximately orthogonal to the conveyance direction of the print medium 2, and performs continuous printing while conveying the plurality of print media 2 continuously or intermittently. The full-line printhead 3 is provided with a negative pressure control unit 230 that controls the pressure (negative pressure) in an ink channel, a liquid supply unit 220 that communicates with the negative pressure control unit 230, and a liquid connecting portion 111 that serves as an ink supply and discharge port to the liquid supply unit 220.

A housing 80 is provided with the negative pressure control unit 230, the liquid supply unit 220, and the liquid connecting portion 111.

Note that the print medium 2 is not limited to a cut sheet, and may be a continuous roll sheet.

The full-line printhead (to be referred to as the printhead hereinafter) 3 can perform full-color printing by cyan (C), magenta (M), yellow (Y), and black (K) inks. A main tank and the liquid supply unit 220 serving as a supply channel for supplying ink to the printhead 3 are connected to the printhead 3. An electric controller (not shown) that transmits power and a discharge control signal to the printhead 3 is electrically connected to the printhead 3.

The print medium 2 is conveyed by rotating two conveyance rollers 81 and 82 provided apart from each other by a distance of F in the conveyance direction of the print medium 2.

The printhead according to this embodiment employs the inkjet method of discharging ink using thermal energy. Therefore, each orifice of the printhead 3 includes an electrothermal transducer (heater). The electrothermal transducer is provided in correspondence with each orifice. When a pulse voltage is applied to the corresponding electrothermal transducer in accordance with a print signal, ink is heated and discharged from the corresponding orifice. Note that the printing apparatus is not limited to the above-described printing apparatus using the full-line printhead whose printing width corresponds to the width of the print medium. For example, the present invention is also applicable to a so-called serial type printing apparatus that mounts, on a carriage, a printhead in which orifices are arrayed in the conveyance direction of the print medium and performs printing by discharging ink to the print medium while reciprocally scanning the carriage.

<Explanation of Control Arrangement (FIG. 2)>

Figure 2:
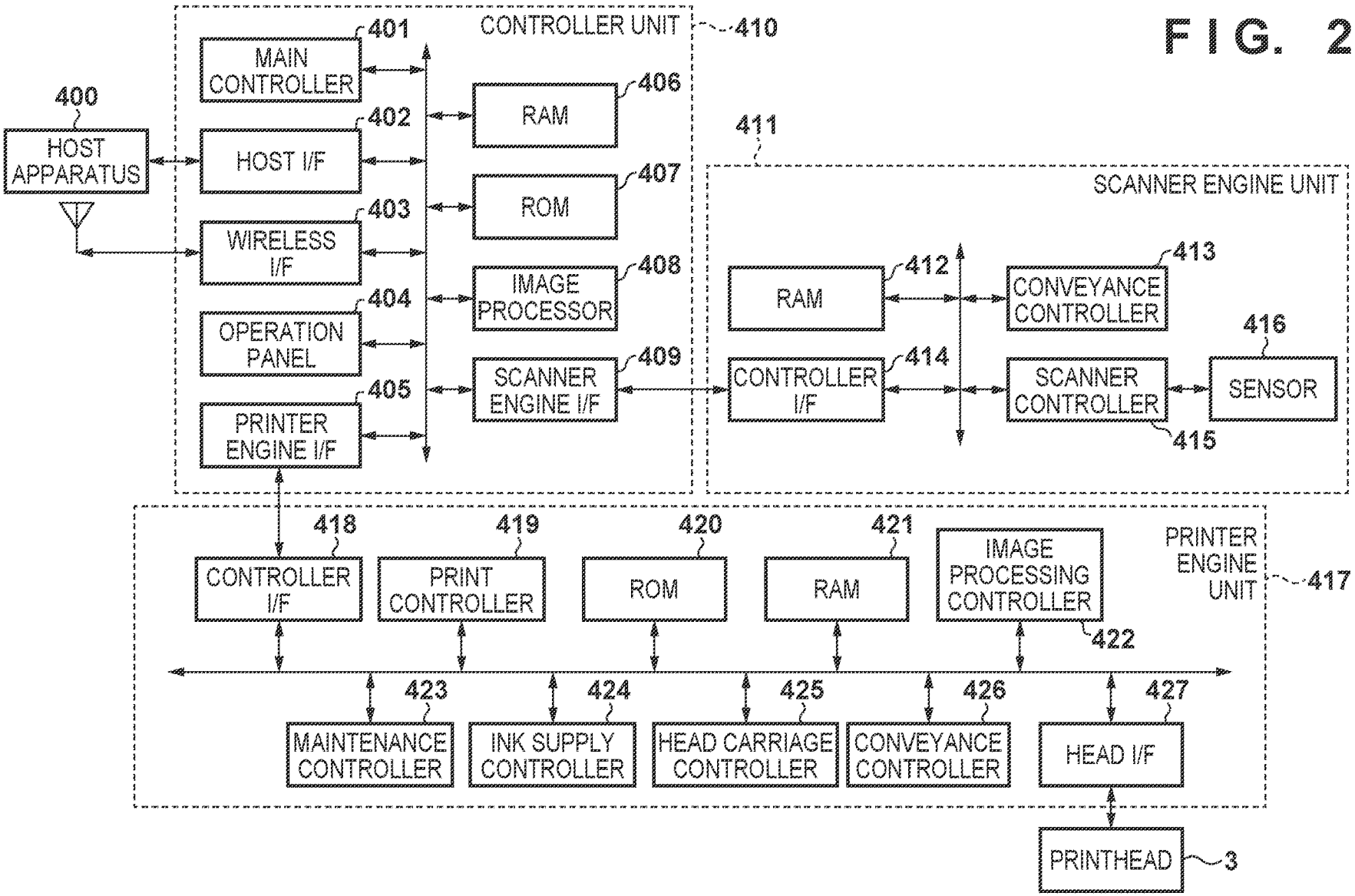
FIG. 2 is a block diagram illustrating a control configuration of the printing apparatus illustrated in FIG. 1.

FIG. 2 is a block diagram showing the arrangement of the control circuit of the printing apparatus 1000.

As shown in FIG. 2, the printing apparatus 1000 is formed by a printer engine unit 417 that mainly controls a printing unit, a scanner engine unit 411 that controls a scanner unit, and a controller unit 410 that controls the overall printing apparatus 1000. A print controller 419 integrating an MPU and a non-volatile memory (EEPROM or the like) controls various mechanisms of the printer engine unit 417 in accordance with an instruction from a main controller 401 of the controller unit 410. The various mechanisms of the scanner engine unit 411 are controlled by the main controller 401 of the controller unit 410.

Details of the control arrangement will be described below.

In the controller unit 410, the main controller 401 formed by a CPU controls the overall printing apparatus 1000 by using a RAM 406 as a work area in accordance with a program and various parameters stored in a ROM 407. For example, if a print job is input from a host apparatus 400 via a host I/F 402 or a wireless I/F 403, an image processor 408 performs predetermined image processing for received image data in accordance with an instruction from the main controller 401. The main controller 401 transmits, to the printer engine unit 417 via a printer engine I/F 405, the image data having undergone the image processing.

Note that the printing apparatus 1000 may obtain image data from the host apparatus 400 via wireless or wired communication, or obtain image data from an external storage device (USB memory or the like) connected to the printing apparatus 1000. A communication method used for wireless or wired communication is not limited. For example, as a communication method used for wireless communication, Wi-Fi (Wireless Fidelity)® or Bluetooth® is applicable. Furthermore, as a communication method used for wired communication, USB (Universal Serial Bus) or the like is applicable. For example, if a read command is input from the host apparatus 400, the main controller 401 transmits the command to the scanner engine unit 411 via a scanner engine I/F 409.

An operation panel 404 is a unit used by the user to perform an input/output operation for the printing apparatus 1000. The user can instruct an operation such as a copy or scan operation via the operation panel 404, set a print mode, and recognize information of the printing apparatus 1000.

In the printer engine unit 417, the print controller 419 formed by a CPU controls the various mechanisms of the printer engine unit 417 by using a RAM 421 as a work area in accordance with a program and various parameters stored in a ROM 420.

Upon receiving various commands or image data via a controller I/F 418, the print controller 419 temporarily saves the received data in the RAM 421. So as to use the printhead 3 for a print operation, the print controller 419 causes an image processing controller 422 to convert the saved image data into print data. When the print data is generated, the print controller 419 causes, via a head I/F 427, the printhead 3 to execute a print operation based on the print data. At this time, the print controller 419 drives the conveyance rollers 81 and 82 via a conveyance controller 426 to convey the print medium 2. In accordance with an instruction from the print controller 419, a print operation is executed by the printhead 3 in synchronism with the conveyance operation of the print medium 2, thereby performing print processing.

A head carriage controller 425 changes the orientation and position of the printhead 3 in accordance with an operation status such as the maintenance status or print status of the printing apparatus 1000. An ink supply controller 424 controls the liquid supply unit 220 so that the pressure of ink supplied to the printhead 3 falls within an appropriate range. A maintenance controller 423 controls the operation of a cap unit or wiping unit in a maintenance unit (not shown) when performing a maintenance operation for the printhead 3.

In the scanner engine unit 411, the main controller 401 controls the hardware resources of a scanner controller 415 by using the RAM 406 as a work area in accordance with a program and various parameters stored in the ROM 407. This controls the various mechanisms of the scanner engine unit 411. For example, the main controller 401 controls the hardware resources in the scanner controller 415 via a controller I/F 414, and conveys, via a conveyance controller 413, a document stacked on an ADF (not shown) by the user, thereby reading the document by a sensor 416. Then, the scanner controller 415 saves read image data in a RAM 412.

Note that the print controller 419 can cause the printhead 3 to execute a print operation based on the image data read by the scanner controller 415 by converting, into print data, the image data obtained as described above.

<Description of Maintenance Operation (FIG. 3A and FIG. 3B)>

Next, the maintenance operation for the printhead 3 will be described.

Figure 3A:
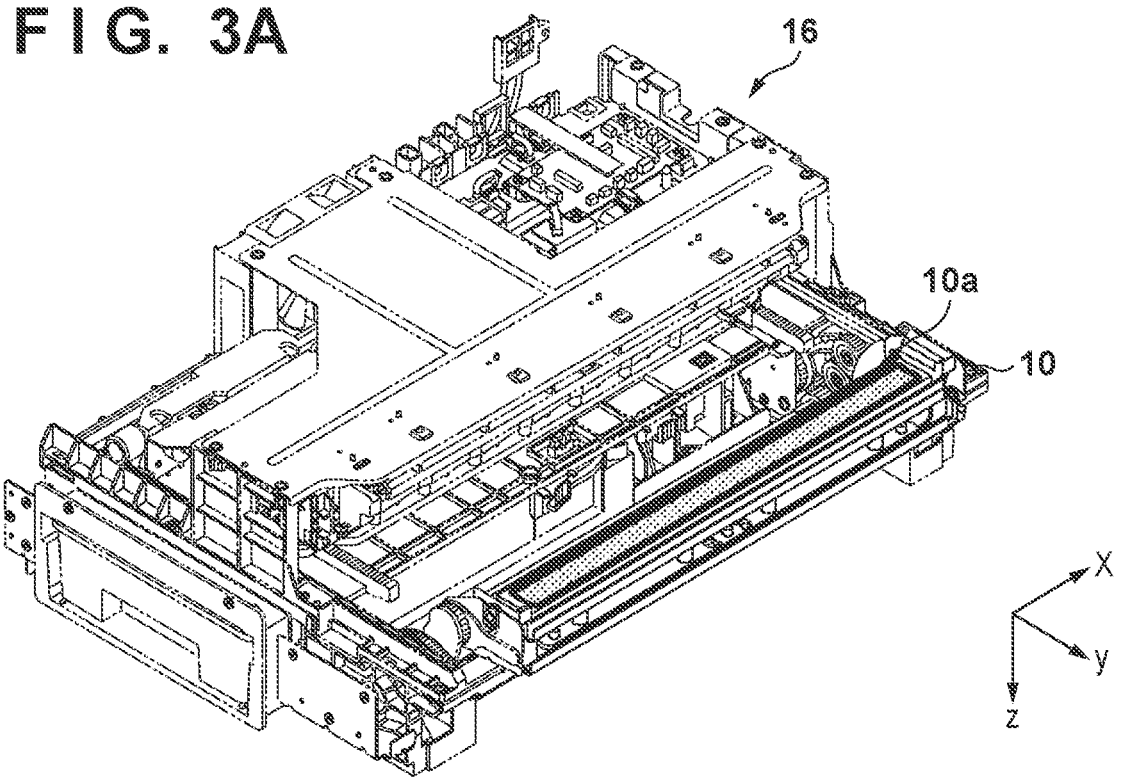
FIGS. 3A and 3B are views for describing a maintenance unit.
Figure 3B:
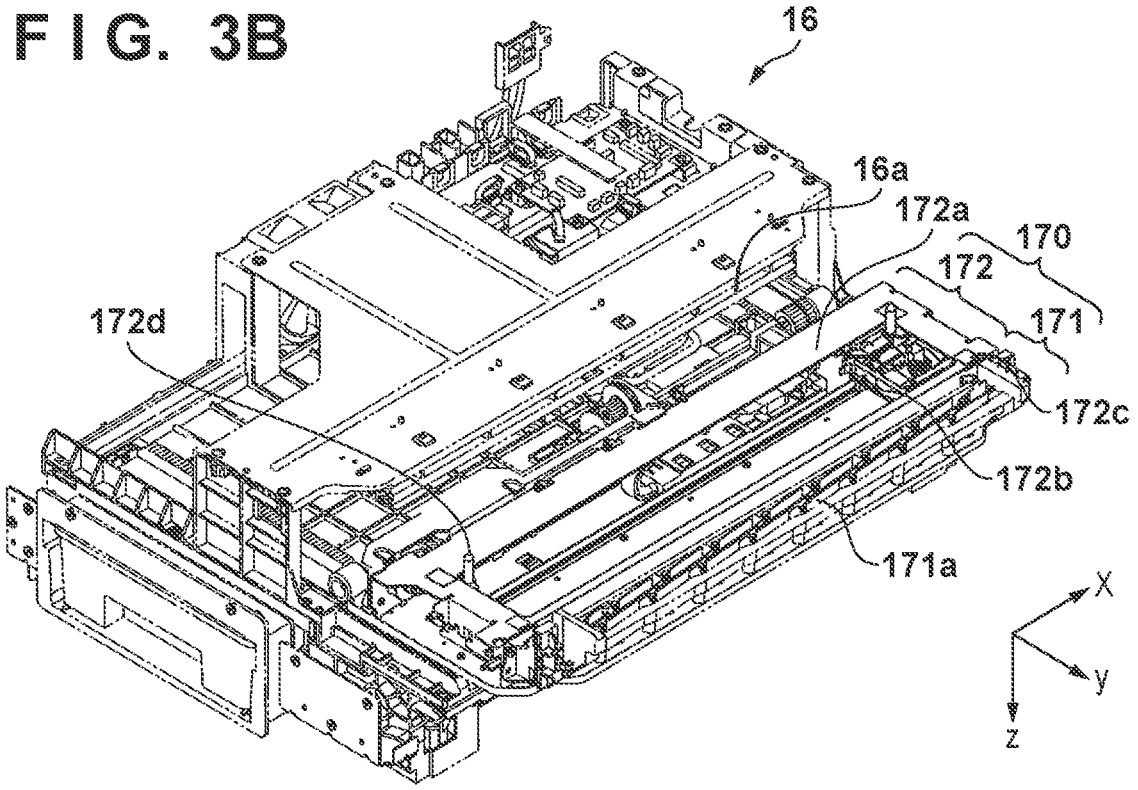

FIG. 3A and FIG. 3B are perspective views illustrating the configuration of the maintenance unit. FIG. 3A illustrates a state in which the maintenance unit 16 is in a standby position, and FIG. 3B illustrates a state in which the maintenance unit 16 is in a maintenance position.

As illustrated by FIG. 3A and FIG. 3B, the maintenance unit 16 has a cap unit 10 and a wiping unit 170, and operates these at a predetermined time to perform a maintenance operation.

When a maintenance operation for the printhead 3 is executed, the printhead 3 moves to a maintenance position at which the maintenance operation can be performed, and the printhead 3 moves to a standby position when in a state other than during printing or during maintenance.

As illustrated in FIG. 3A, when the printhead is in the standby position, the cap unit 10 moves upward in the vertical direction (z direction), and the wiping unit 170 is accommodated inside the maintenance unit 16. The cap unit 10 has a box-like cap member 10*a* extending in the y-direction, and by causing the cap member 10*a* to be in close contact with the discharge surface of the printhead 3, it is possible to suppress evaporation of ink from the discharge ports. The cap unit 10 is also provided with a function of collecting ink in accordance with preliminary discharge in a state where the cap member 10*a* is caused to be in close contact with the discharge surface of the printhead 3, and causing a suction pump (not illustrated) to suck up collected ink.

However, as illustrated in FIG. 3B, when the printhead is in the maintenance position, the cap unit 10 moves downward in the vertical direction (z direction), and the wiping unit 170 is pulled out from the maintenance unit 16. The wiping unit 170 includes two wiper units: a blade wiper unit 171 and a vacuum wiper unit 172.

In the blade wiper unit 171, a blade wiper 171*a* for wiping the discharge surface along the x-direction is arranged in the y-direction by a length corresponding to the arrangement region of the discharge ports. When a wiping operation using the blade wiper unit 171 is performed, the wiping unit 170 moves the blade wiper unit 171 in the x direction in a state where the printhead is positioned at a height at which the printhead can contact with the blade wiper 171*a*. By this movement, ink or the like adhering to the discharge surface is wiped away by the blade wiper 171*a*.

At the entrance of the maintenance unit 16 when the blade wiper 171*a* is housed, a wet wiper cleaner 16*a* for removing ink adhering to the blade wiper 171*a* and for applying a wet liquid onto the blade wiper 171*a* is disposed. Each time the blade wiper 171*a* is housed in the maintenance unit 16, the wet wiper cleaner 16*a* removes deposits and applies a wet liquid. Then, when the discharge surface is next wiped, the wet liquid is transferred to the discharge surface to prevent the discharge surface from drying.

On the other hand, the vacuum wiper unit 172 includes a flat plate 172*a* having an opening extending in the y direction, a carriage 172*b* movable in the opening in the y direction, and a vacuum wiper 172*c* mounted on the carriage 172*b*. The vacuum wiper 172*c* can wipe the discharge surface in the y direction as the carriage 172*b* moves. A suction port connected to a suction pump (not illustrated) is formed at the distal end of the vacuum wiper 172*c*. Therefore, when the carriage 172*b* is moved in the y direction while operating the suction pump, the ink or the like adhering to the discharge surface of the printhead is sucked into the suction port while being wiped theretowards by the vacuum wiper 172*c*. At this time, the flat plate 172*a* and positioning pins 172*d* provided at both ends of the opening are used for alignment of the discharge surface with respect to the vacuum wiper 172*c*.

Here, a first wiping process in which a wiping process is performed by the blade wiper unit 171 and a wiping operation is not performed by the vacuum wiper unit 172, and a second wiping process in which both wiping processes are performed in order are provided. When the first wiping process is performed, the print controller 419 first pulls out the wiping unit 170 from the maintenance unit 16, in a state where the printhead 3 has been retracted upward in the vertical direction (z direction) from the maintenance position. After the printhead 3 is moved downward in a vertical direction (z direction) to a position where it can contact with the blade wiper 171*a*, the wiping unit 170 is caused to move into the maintenance unit 16. By this movement, ink or the like adhering to the discharge surface is wiped away by the blade wiper 171*a*.

When the blade wiper unit 171 is housed, the print controller 419 then causes the cap unit 10 to move upward in the vertical direction (z direction) to bring the cap member 10*a* into close contact with the discharge surface of the printhead 3. Then, in this state, the printhead 3 is driven to cause preliminary discharge to be performed, and the ink collected in the cap is sucked by the suction pump. The above is a series of steps in the first wiping process.

Here, it is assumed that the first wiping process is executed once every time print operations for 100 pages of print media are performed.

On the other hand, when performing the second wiping process, the print controller 419 first positions the printhead 3 at a height where it is in contact with the blade wiper 171*a*, and, in this state, slides the wiping unit 170 out of the maintenance unit 16. As a result, a wiping operation in accordance with the blade wiper 171*a* is performed on the discharge surface. Next, the discharge surface of the printhead 3 and the vacuum wiper unit 172 are positioned using the flat plate 172*a* and the positioning pin 172*d*, and the above-described wiping operation by the vacuum wiper unit 172 is performed. Thereafter, the printhead 3 is caused to retract upward in the vertical direction (z direction), the wiping unit 170 is accommodated, and then, similarly to the first wiping process, preliminary discharge into the cap member in accordance with the cap unit 10 and a suction operation of the collected ink are performed. The above is a series of steps in the second wiping process.

The second wiping process has a greater cleaning effect on the discharge surface than the first wiping process, but has a longer processing time. Therefore, it is assumed that the second wiping process is executed once for every 50 times the first wiping process is performed. In other words, the second wiping process is executed once every time print operations for 5000 pages of print media have been performed.

<Description of Ink Circulation Configuration (FIG. 4)>

The printing apparatus 1000 employs a configuration in which ink is caused to circulate between an ink tank and the printhead 3.

Figure 4:
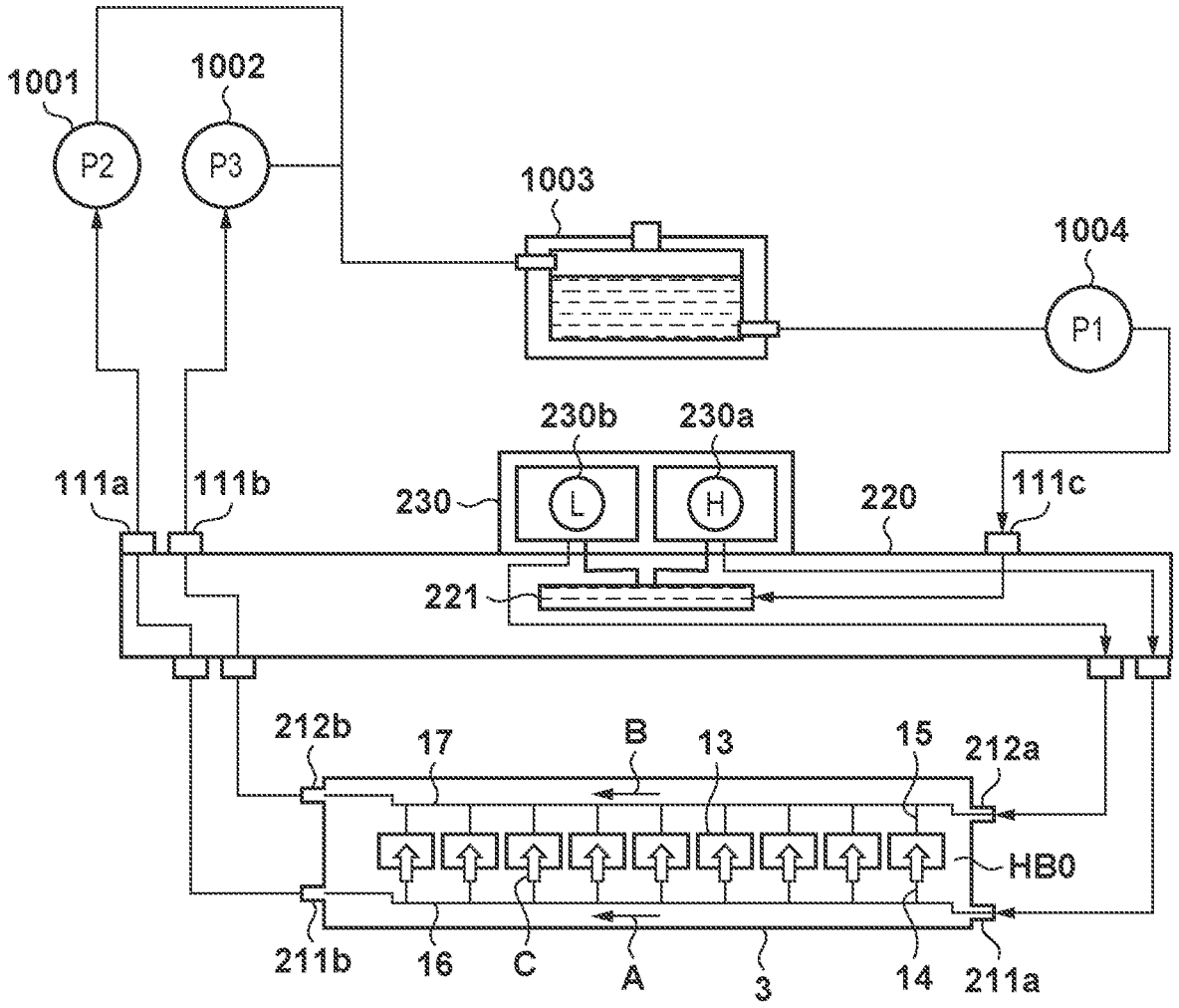
FIG. 4 is a view for describing an ink circulation system.

FIG. 4 is a schematic view illustrating an ink circulation configuration.

The printhead 3 is connected to a first circulation pump (P2) 1001 on a high pressure side, a second circulation pump (P3) 1002 on a low pressure side, and a main tank (an ink tank) 1003. The main tank 1003 can eject bubbles in ink to the outside through an air communication port (not illustrated) that joins the inside of the main tank 1003 with the outside. The ink in the main tank 1003 is consumed by image printing and recovery processing (including preliminary discharge, suction ejection, pressurization ejection, and the like), and when it becomes empty, the main tank 1003 is detached from the printing apparatus and replaced.

In the printhead 3, a plurality (for example, 15) of element substrates (heater boards) on which a plurality of print elements are integrated are arrayed in the width direction of a print medium so that a print width of the printhead 3 is lengthened to form a full-line printhead. Note that, in order to simplify the explanation, only one heater board HB0 is illustrated in FIG. 4.

For example, as described above, the ink common supply channel 16 and the ink common collection channel 17 are provided in each of the fifteen heater boards HB0 to HB14, and a plurality of pressure chambers 13 are formed therebetween to communicate with each other via the ink supply port 14 and the ink collection port 15. Although only the heater board HB0 of the heater boards HB0 to HB14 is illustrated in FIG. 4 for simplicity, the heater boards HB0 to HB14 are in fact connected in series. Incidentally, the heater board HB0 is positioned most upstream in the ink circulation direction and the heater board HB14 is positioned downstream, and the larger the number (HBi) of the heater board is, the more the heater board is positioned downstream.

The first circulation pump 1001 sucks ink in the ink common supply channel 16 through the connecting portion 111*a* of the negative-pressure control unit 230 and the outlet port 211*b* of the printhead 3, and returns the ink to the main tank 1003. In contrast, the second circulation pump 1002 sucks ink in the ink common collection channel 17 through the connecting portion 111*b* of the negative-pressure control unit 230 and the outlet port 212*b* of the printhead 3, and returns the ink to the main tank 1003. As the first circulation pump 1001 and the second circulation pump 1002, a positive-displacement pump having a quantitative liquid supply capability is preferable. Specifically, the following can be given: a tube pump, a gear pump, a diaphragm pump, a syringe pump, or the like. A generic constant flow valve or relief valve may be disposed at the outlet of the pump to ensure a constant flow rate.

When the printhead 3 is driven, in accordance with the first circulation pump 1001 and the second circulation pump 1002, a predetermined amount of ink flows in the arrow A direction (supply direction) and the arrow B direction (collection direction) in FIG. 4 of the ink common supply channel 16 and the ink common collection channel 17, respectively. A flow rate of the ink is set to an amount so that a temperature difference between the heater boards HB0 to HB14 can be reduced to a level where there is no influence on the image quality of a printed image. However, if the flow rate is excessively large, there is a possibility that the difference in negative pressure in the respective heater boards HB0 to HB14 will become excessively large due to the effect of a pressure drop in the flow paths in the printhead 3, and density unevenness of a printed image will occur. Therefore, it is preferable to set ink flow rates in the ink common supply channel 16 and the ink common collection channel 17 in view of the temperature difference and the negative pressure difference between the heater boards HB0 to HB14.

The negative-pressure control unit 230 is provided in a flow path between the third circulation pump (P1) 1004 and the printhead 3. The negative-pressure control unit 230 has a function of maintaining the pressure of the ink on the side for the printhead 3 at a constant even when the flow rate of ink in the ink circulation system fluctuates according to the density (a discharge amount) of a printed image. As two pressure regulating mechanisms 230*a* and 230*b* that configure the negative-pressure control unit 230, any mechanism may be used as long as it has a configuration of being able to control the pressure in the downstream flow path thereof to be within a certain range that is centered on a desired set pressure. As an example, a mechanism similar to a so-called pressure reducing regulator can be employed.

In the case of using a pressure reducing regulator, as illustrated in FIG. 4, it is advantageous to pressurize the inside of the upstream flow path of the negative-pressure control unit 230 through the liquid (ink) supply unit 220 by the third circulation pump (P1) 1004. As a result, it is possible to suppress the influence of the hydraulic head pressure between the main tank 1003 and the printhead 3 on the printhead 3, and increase the degree of freedom for layout of the main tank 1003 in the printing apparatus. The third circulation pump 1004 is connected to the pressure regulating mechanisms 230*a* and 230*b* via the connecting portion 111*c* and the filter 221 of the liquid (ink) supply unit 220. The third circulation pump 1004 may have a lift pressure equal to or higher than a predetermined pressure in the range of the circulation flow rate of the ink when the printhead 3 is driven, and a turbo type pump, a positive-displacement pump, or the like can be used. For example, a diaphragm pump or the like can be applied. Instead of the third circulation pump 1004, a hydraulic head tank disposed with a certain hydraulic head difference with respect to the negative-pressure control unit 230 can also be applied.

The two pressure regulating mechanisms 230*a* and 230*b* in the negative-pressure control unit 230 are respectively set with differing control pressures. Since the pressure regulating mechanism 230*a* is set to a relatively high pressure, it is referred to as "H" in FIG. 4, and the pressure regulating mechanism 230*b* is set to a relatively low pressure, it is referred to as "L" in FIG. 4. The pressure regulating mechanism 230*a* is connected to the inlet port 211*a* of the ink common supply channel 16 in the printhead 3 through the liquid (ink) supply unit 220. The pressure regulating mechanism 230*b* is connected to the inlet port 212*a* of the ink common collection channel 17 in the printhead 3 through the liquid (ink) supply unit 220.

The high pressure side pressure regulating mechanism 230*a* is connected to the inlet port 211*a* of the ink common supply channel 16, and the low pressure side pressure regulating mechanism 230*b* is connected to the inlet port 212*a* of the ink common collection channel 17. Therefore, a negative pressure difference occurs between the ink common supply channel 16 and the ink common collection channel 17. Therefore, some of the ink flowing in the direction of arrows A and B in the ink common supply channel 16 and the ink common collection channel 17 flows in the direction of arrows C through ink supply ports 14, the pressure chambers 13, and the ink collection ports 15.

In this manner, in the printhead 3, ink flows in the directions of the arrows A and B in the ink common supply channel 16 and the ink common collection channel 17 in each of the heater boards HB0 to HB14. Therefore, heat generated in each of the heater boards HB0 to HB14 can be exhausted to the outside in accordance with the flow of ink in the ink common supply channel 16 and the ink common collection channel 17.

With such a configuration, during a print operation, it is possible to suppress an increase in ink viscosity in the discharge ports and the pressure chambers 13 by causing a flow of ink in the direction of arrow C to also occur for the discharge ports and the pressure chambers 13 that do not discharge ink. In addition, for ink whose viscosity has increased in the discharge ports and the pressure chambers 13, by causing the flow of the ink to occur in the direction of the arrow C for a predetermined period of time, there are effects of causing the ink whose viscosity has increased to dissolve, and restoring the discharge port and the pressure chamber 13 to a normal state.

As a result, high-speed printing of a high-quality image can be performed using the printhead 3.

<Description of Configuration of Temperature Detection Element (FIG. 5A to FIG. 5C)>

Figure 5C:
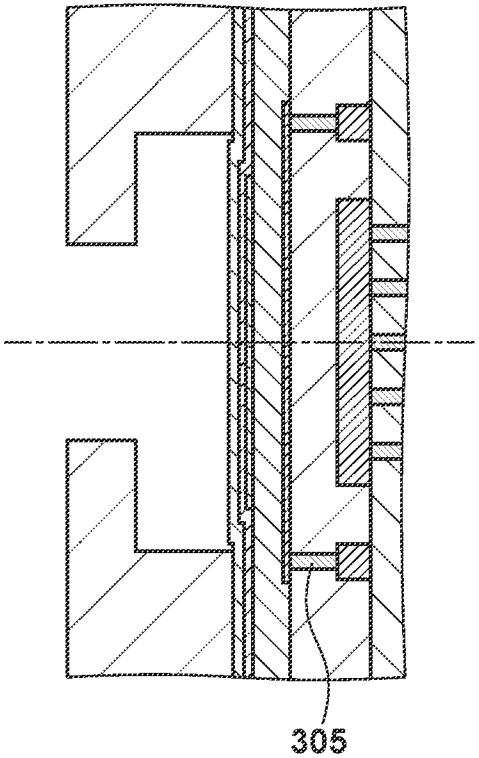
FIGS. 5A, 5B, and 5C are views illustrating a multi-layered wiring structure near print elements formed on a silicon substrate.
Figure 5A:
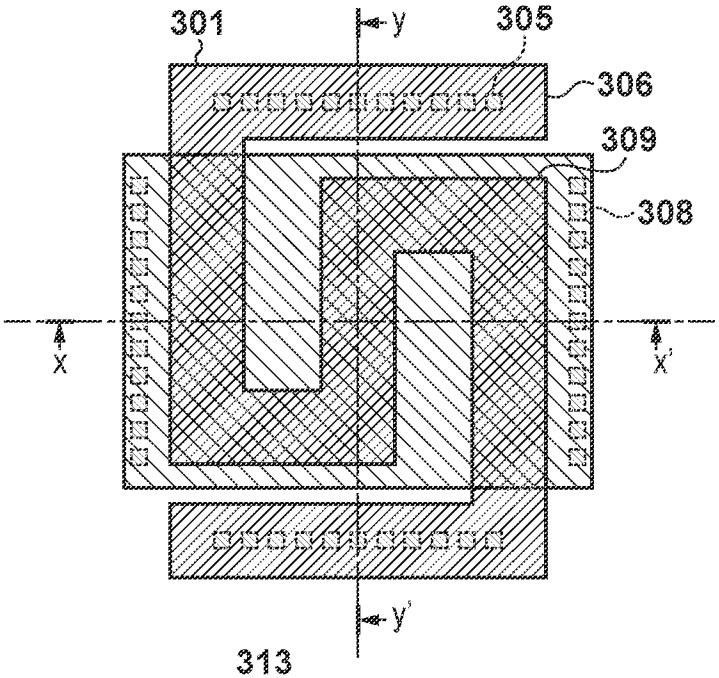
Figure 5B:
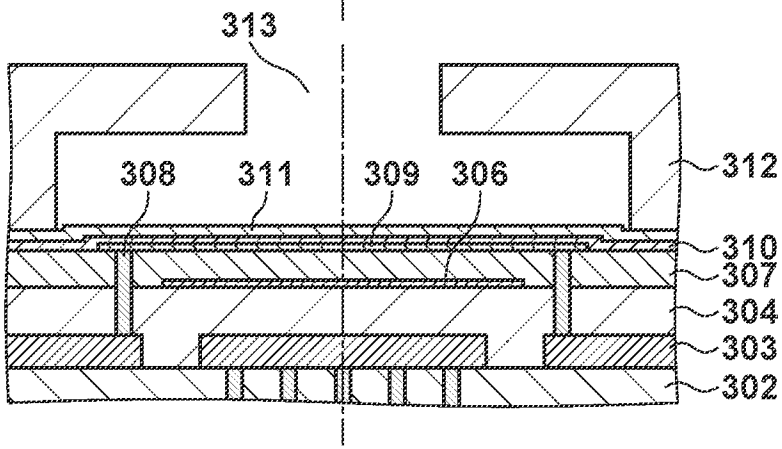

FIG. 5A to FIG. 5C are views illustrating a multi-layered wiring structure in the vicinity of a print element formed on a silicon substrate.

FIG. 5A is a top view in which the temperature detection element 306 is arranged in the form of a sheet in a layer below the print element 309, with an interlayer insulating film 307 interposed therebetween. FIG. 5B is a cross-sectional view along the broken line x-x' in the top view illustrated in FIG. 5A, and FIG. 5C is a cross-sectional view along the broken line y-y' illustrated in FIG. 5A.

In the x-x' cross-sectional view illustrated in FIG. 5B and the y-y' cross-sectional view illustrated in FIG. 5C, a wiring 303 made of aluminum or the like is formed on an insulating film 302 stacked on a silicon substrate, and an interlayer insulating film 304 is further formed on the wiring 303. The wiring 303 and the temperature detection element 306 which is a thin film resistor made of a laminated film of titanium and titanium nitride or the like are electrically connected to each other via a conductive plug 305 made of tungsten or the like that is embedded in the interlayer insulating film 304.

Next, an interlayer insulating film 307 is formed above the temperature detection element 306. Then, the wiring 303 and the print element 309 which is a heating resistor made of a tantalum silicon nitride film or the like are electrically connected to each other via a conductive plug 308 made of tungsten or the like that penetrates the interlayer insulating film 304 and the interlayer insulating film 307.

Note that, in a case of connecting the conductive plug of the lower layer and the conductive plug of the upper layer, they are generally connected with a spacer formed of an intermediate wiring layer interposed therebetween. In the case of applying this embodiment, since the temperature detection element, which serves as the intermediate wiring layer, is a thin film whose film thickness is approximately several tens of nm, in the case of a via hole step, accuracy of overetching control for the temperature detection element membrane that serves as a spacer is needed. In addition, it is disadvantageous for miniaturization of the pattern of the temperature detection element layer. In view of such circumstances, in this embodiment, a conductive plug that penetrates the interlayer insulating film 304 and the interlayer insulating film 307 is employed.

In addition, in order to ensure the reliability of conduction in accordance with the depth of the plug, in this embodiment, the conductive plug 305, for which there is a one layer interlayer insulating film, has a diameter set to 0.4 μm, and the conductive plug 308 that penetrates interlayer insulating films of two layers has a larger diameter that is set to 0.6 μm.

Next, a protective film 310 such as a silicon nitride film and a cavitation resistant film 311 such as tantalum are formed on the protective film 310 to form a head substrate (an element substrate). Further, a discharge port 313 is formed by a nozzle-forming material 312 made of a photosensitive resin or the like.

Thus, a multi-layered wiring structure is created in which the temperature detection element 306 which is an intermediate layer is separately provided between the layer of the wire 303 and the layer of the print element 309.

From the above configuration, with the element substrate used in this embodiment, temperature information can be obtained for each print element in accordance with the temperature detection element provided corresponding to each print element.

Based on temperature information detected by the temperature detection element and temperature change of the temperature information, in accordance with a logical circuit (inspection portion) provided inside the element substrate, it is possible to obtain a determination result signal RSLT indicating an ink discharge state from the corresponding print element. The determination result signal RSLT is a 1-bit signal, where "1" indicates normal discharge and "0" indicates discharge failure.

<Description of Temperature Detection Configuration (FIG. 6)>

Figure 6:
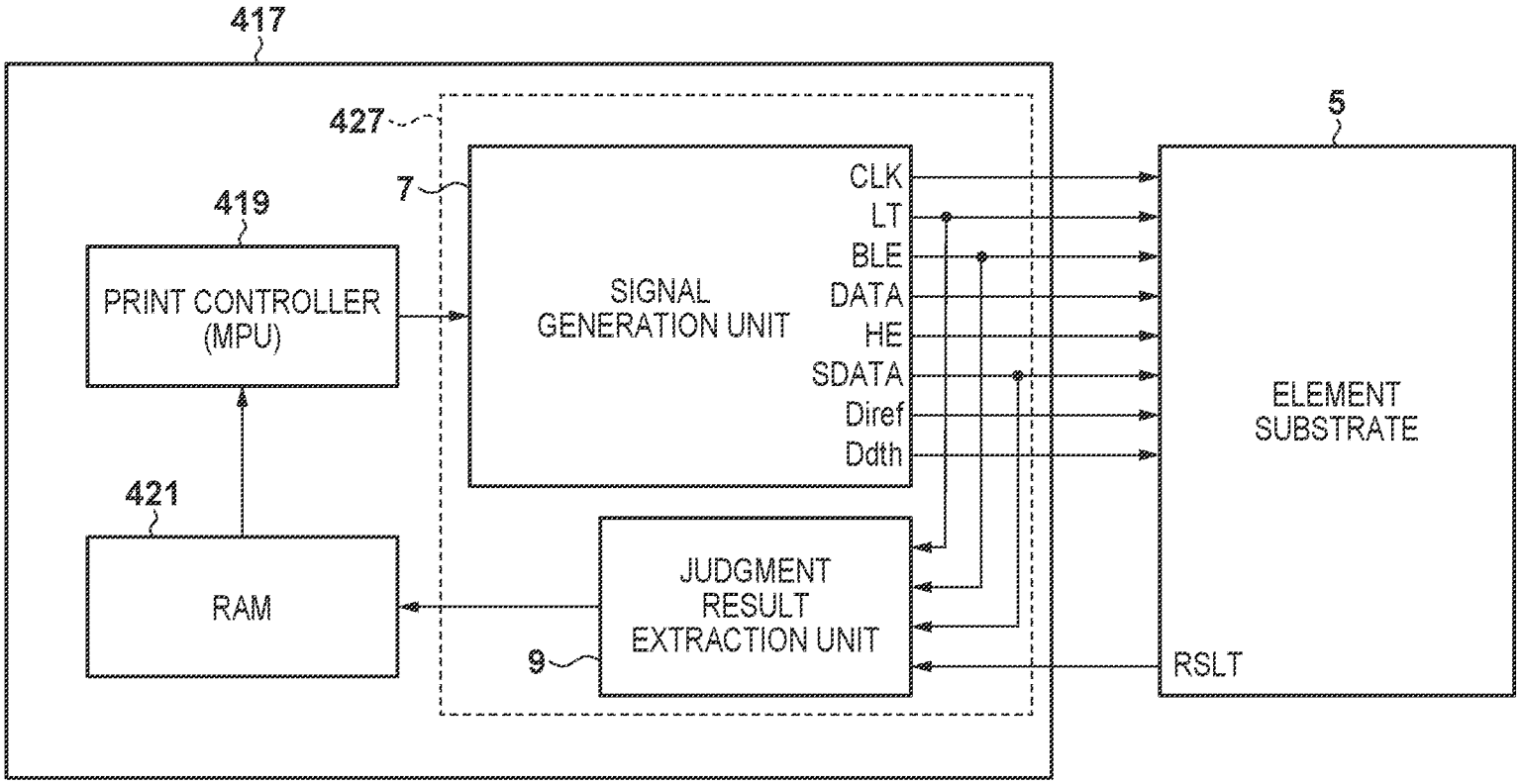
FIG. 6 is a block diagram illustrating a control configuration of temperature detection using the element substrate illustrated in FIGS. 5A to 5C.

FIG. 6 is a block diagram illustrating a control configuration of temperature detection using the element substrate illustrated in FIG. 5A to FIG. 5C.

As illustrated in FIG. 6, for detecting temperatures of the print elements mounted on the element substrate 5, the print engine unit 417 includes a print controller 419 having a built-in MPU, a head I/F 427 connected to the printhead 3, and a RAM 421. The head I/F 427 also includes a signal generating unit 7 for generating various signals to be transmitted to the element substrate 5, and a determination result extraction unit 9 for inputting a determination result signal RSLT outputted from the element substrate 5 based on the temperature information detected by the temperature detection element 306.

When the print controller 419 issues an instruction to the signal generating unit 7 for temperature detection, the signal generating unit 7 outputs a clock signal CLK, a latch signal LT, a block signal BLE, a print data signal DATA, and a heat enable signal HE to the element substrate 5. The signal generating unit 7 further outputs a sensor selection signal SDATA, a constant current signal Diref, and a discharge inspection threshold signal Ddth.

The sensor selection signal SDATA includes selection information for selecting a temperature detection element for detecting temperature information, designation information for an amount of energization for the selected temperature detection element, and information related to an instruction for outputting the determination result signal RSLT. For example, in a case of a configuration where the element substrate 5 mounts five print element arrays each composed of a plurality of print elements, the selection information included in the sensor selection signals SDATA includes array selection information that designates an array and print element selection information designating the print element of the array. On the other hand, the one-bit determination result signal RSLT based on the temperature information detected by the temperature detection element corresponding to one of the print elements in the array designated by the sensor selection signal SDATA is outputted from the element substrate 5.

Values of "1" indicating normal discharge and "0" indicating discharge failure that are outputted from the determination result signal RSLT are obtained by comparing the temperature information output from the temperature detection element with a discharge inspection threshold voltage (TH) indicated by the discharge inspection threshold signal Ddth inside the element substrate 5. This comparison is described in more detail below.

Note that this embodiment employs a configuration in which a one-bit determination result signal RSLT is outputted for each print element of the five arrays. Therefore, in a configuration in which the element substrate 5 mounts ten print element arrays, the determination result signal RSLT is two bits, and this two-bit signal is serially outputted to the determination result extraction unit 9 via one signal line.

As can be seen from FIG. 6, the latch signal LT, the block signal BLE, and the sensor selection signal SDATA are fed back to the determination result extraction unit 9. On the other hand, the determination result extraction unit 9 receives the determination result signal RSLT outputted from the element substrate 5 based on the temperature information detected by the temperature detection element, and extracts the determination result in the respective latch periods in synchronization with the falling of the latch signal LT. When the determination result is a discharge failure, the block signal BLE and the sensor selection signal SDATA corresponding to the determination result are stored in the RAM 421.

Then, the print controller 419 erases the signal for the discharge failure nozzle from the print data signal DATA of the corresponding block, based on the block signal BLE and the sensor selection signal SDATA used for driving the discharge failure nozzle that were stored in the RAM 421. Instead, nozzles for non-discharge complementing are added to the print data signal DATA of the corresponding blocks, and a result thereof is outputted to the signal generating unit 7.

<Explanation of the Method for Determining Discharge State (FIG. 7 to FIG. 8C)>

Figure 7:
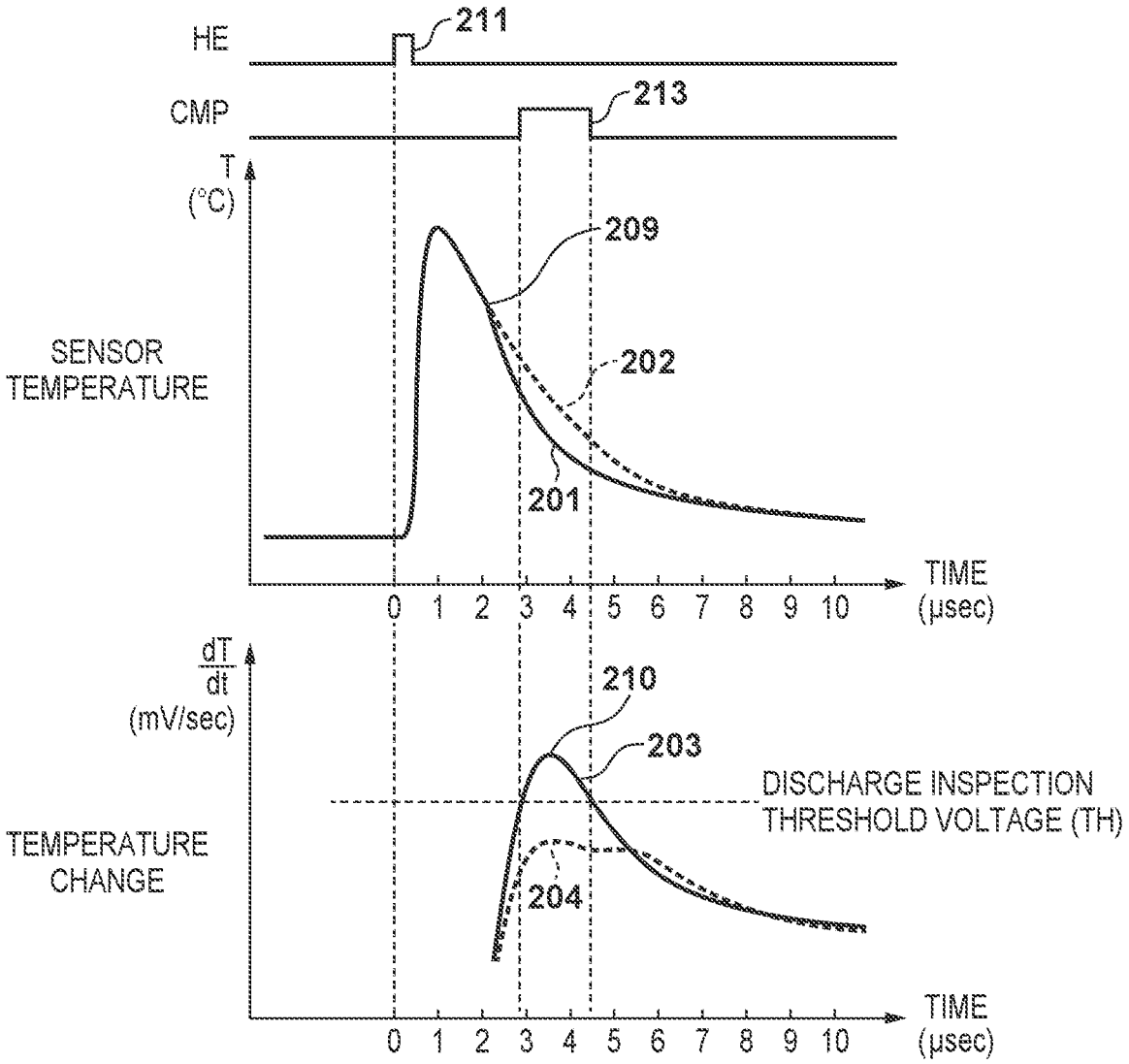
FIG. 7 is a view that represents a temperature waveform outputted from a temperature detection element, when a driving pulse is applied to a print element, and a temperature change signal of the waveform.

FIG. 7 is a diagram that represents a temperature waveform (sensor temperature: T) outputted from the temperature detection element and a temperature change signal (dT/dt) of the waveform when a driving pulse is applied to the print element.

In FIG. 7, the temperature waveform (sensor temperature: T) is represented by temperature (° C.), but in reality, a constant current is supplied to the temperature detection element, and the voltage (V) between the terminals of the temperature detection element is detected. Since the detected voltage has temperature dependence, the detected voltage is converted into temperature and expressed as a temperature in FIG. 7. The temperature change signal (dT/dt) is represented as change of the detected voltage over time (mV/sec).

As illustrated in FIG. 7, in a case where ink is normally discharged when the driving pulse 211 is applied to the print element 309 (normal discharge), the output waveform of the temperature detection element 306 becomes the waveform 201. In a temperature drop process of the temperature detected by the temperature detection element 306 and indicated by the waveform 201, at the time of normal discharge, the tail of the discharged ink droplet is pulled back, and the ink droplet contacts and adheres to the interface (outermost surface) of the print element 309 to cool the interface of the print element 309, thereby causing the feature point 209 to appear. Then, the temperature drop rate of the waveform 201 rapidly increases after the feature point 209. On the other hand, in the case of discharge failure, the output waveform of the temperature detection element 306 becomes as with the waveform 202, the feature point 209 does not appear as with the waveform 201 at the time of normal discharge, and the temperature drop rate gradually decreases in the temperature drop process.

The bottom of FIG. 7 illustrates temperature change signals (dT/dt), and waveforms after the output waveforms 201 and 202 of the temperature detection elements are processed into temperature change signals (dT/dt) are referred to as waveforms 203 and 204. A method of converting to a temperature change signal at this time is appropriately selected according to the system. The temperature change signal (dT/dt) in this embodiment is a waveform which is outputted after the temperature waveform is passed through a filter circuit (in this configuration, one differentiation) and an inverting amplifier.

In the waveform 203, a peak 210 due to the maximum temperature drop rate after the feature point 209 of the waveform 201 appears. The waveform (dT/dt) 203 is compared with the discharge inspection threshold voltage (TH) which is set in advance in a comparator mounted on the element substrate 5, and a pulse indicating normal discharge in an interval where the waveform 203 exceeds the discharge inspection threshold voltage (TH) (dT/dt TH) appears in the determination signal (CMP) 213.

In contrast, since the feature point 209 does not appear in the waveform 202, the temperature drop rate is low, and the peak appearing in the waveform 204 is lower than the discharge inspection threshold voltage (TH). The waveform (dT/dt) 204 is also compared with the discharge inspection threshold voltage (TH) that is preset in the comparator mounted on the element substrate 5. In an interval where the waveform is less than the discharge inspection threshold voltage (TH) (dT/dt<TH), a pulse does not appear in the determination signal 213.

Therefore, the discharge state of each nozzle can be grasped by acquiring the determination signal (CMP). The determination signal (CMP) becomes the determination result signal RSLT described above.

In the main body of the printing apparatus, a value (Dref) corresponding to the voltage of the peak 210 at a time of normal discharge is held in advance, and the discharge inspection threshold voltage (TH) is set as a relative value with respect to that value. In this embodiment, the discharge inspection threshold voltage is set by a relative rank from Dref. It should be noted that the value (Dref) corresponding to the voltage of the peaks 210 at a time of normal discharge may be measured and updated by the main body of the printing apparatus at predetermined timings.

Issues in the Determination of the Discharge State

Figures 8A, 8B, 8C:
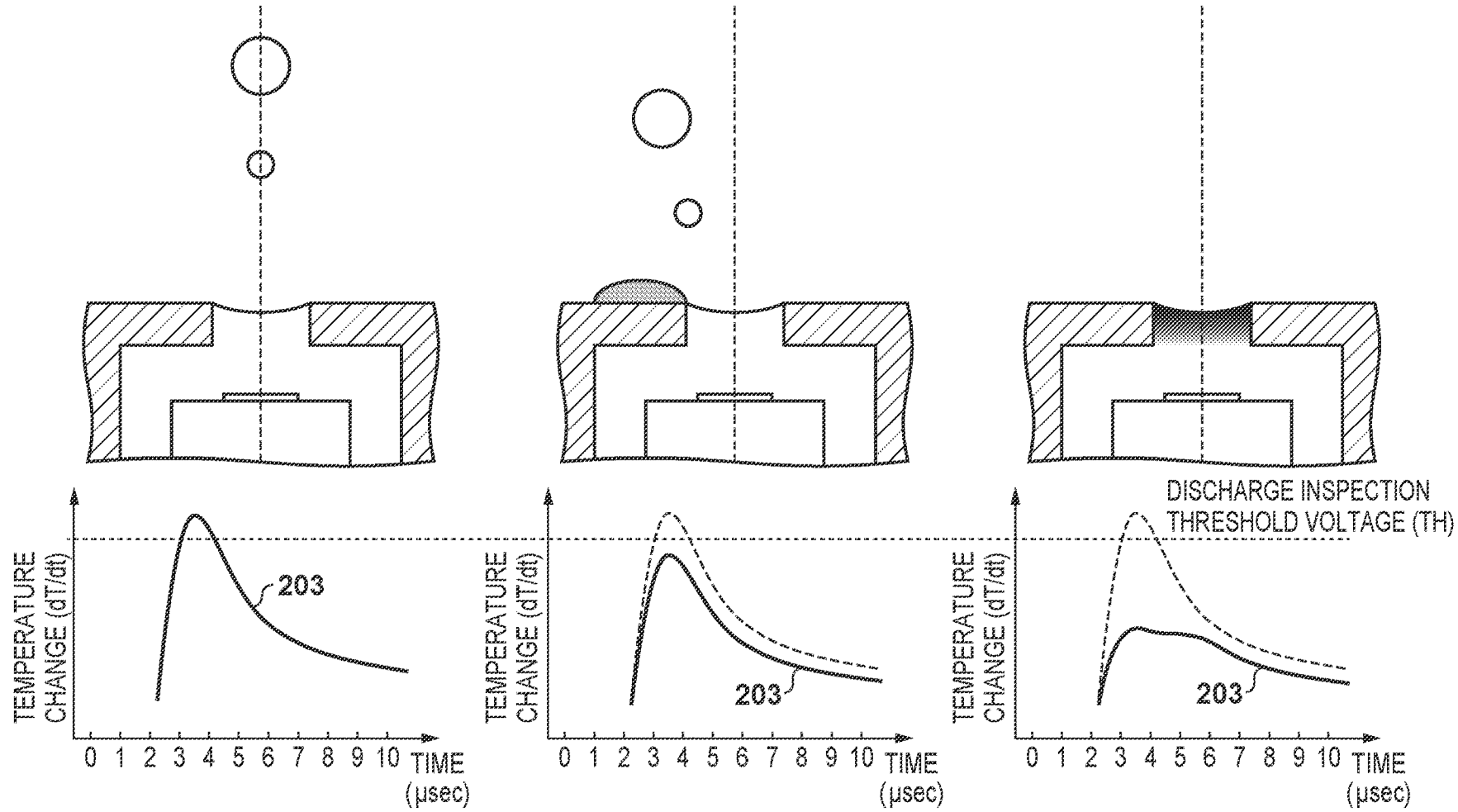
FIGS. 8A, 8B and 8C are schematic views of three discharge states and views illustrating waveforms of the temperature change signal (dT/dt) which is based on a temperature waveform signal detected by the temperature detection element at corresponding times.

FIG. 8A to FIG. 8C are schematic views of nozzle parts and discharged ink droplets in three discharge states, and views illustrating waveforms of a temperature change signal (dT/dt) based on the temperature waveform signal detected by the temperature detection element in each state.

FIG. 8A is a schematic view of a discharge state in a case where ink is subject to normal discharge and a view illustrating a profile of change in temperature. Here, the discharge inspection threshold voltage (TH) is set to be lower than the peak of the waveform 203 at a time of normal discharge. Therefore, by comparing the discharge inspection threshold voltage (TH) with the temperature change signal (dT/dt), a determination of normal discharge is made.

FIG. 8B is a schematic view of a case in which an ink droplet has adhered to a discharge surface and linearity of the flight of discharged ink droplets is bad, and a view illustrating a profile of temperature change. Since the ink droplets have poor linearity, a position where they reach the print medium deviates from an intended position, and because this can be seen as, for example a white streak or a dark streak in the vicinity thereof, this is a cause of degradation in image quality. This phenomenon is not limited to the adhesion of ink droplets to the discharge surface, but is caused by various factors such as the adhesion of paper dust originated from a print medium, dust floating in the air, or the like. When this state is entered, it is necessary to clean the discharge surface by a maintenance process.

In the waveform 203 at this time, although the flight trajectory of the discharged ink droplet is not linear, a bubbling phenomenon due to heating on the heater is created, so that a temperature change signal of a certain degree is output. However, as illustrated in FIG. 8B, the peak value is lower than the peak value of the waveform 203 at the time of normal discharge illustrated in FIG. 8A (dotted line in FIG. 8B). The reason for this is considered to be that the flight of discharged ink is affected by a foreign substance on the discharge surface, and there is a change of the amount of the tail of the discharged ink droplet, the position at which the tail reaches the interface of the print element 309, or the timing at which the tail reaches the interface.

Since the discharge inspection threshold voltage (TH) is set higher than the peak of the waveform in this state, the discharge inspection threshold voltage (TH) and the temperature change signal (dT/dt) are compared with each other to thereby determine a discharge failure.

FIG. 8C is a schematic view of a case where ink droplets are not discharged due to an increase in viscosity or solidification of ink inside a nozzle of the printhead, and a view illustrating a profile of temperature change. Since an ink droplet is not discharged, a state is entered in which there is no ink droplet at an intended position on the print medium, and this is visually recognized as a white streak, which is also a cause of image quality degradation. When this state is entered, it is necessary to, by a maintenance process, remove the ink having an increased viscosity in the nozzle or ink that has solidified on the discharge surface. In such a case, although recovery is possible by the aforementioned vacuum wiping or the like, there is a drawback that the amount of ink consumed is large. In this embodiment, by executing an ink circulation operation and continuing to supply fresh ink into the nozzle for a predetermined period, it is possible to cause the nozzle state to recover by dissolving ink having increased viscosity or ink that has solidified without consuming the ink.

Since the discharge inspection threshold voltage (TH) is set higher than the peak of the waveform 203 in this state, the discharge inspection threshold voltage (TH) and the temperature change signal (dT/dt) are compared with each other to thereby determine a discharge failure. Note that, in FIG. 8C, a waveform in a case where normal discharge is performed is indicated by a dotted line for reference.

As described by FIG. 8A to FIG. 8C above, the peak value of the temperature change signal (dT/dt) differs in accordance with being in a state of normal discharge, a state of discharge failure, or a state of non-discharge. Therefore, when the conventional determination of the discharge state is performed, the following determination result signals RSLT are outputted in accordance with a comparison with the discharge determination threshold voltage (TH). In other words:

in the case of FIG. 8A, the determination result signal RSLT is "1"; in the case of FIG. 8B, the determination result signal RSLT is "0"; and in the case of FIG. 8C, the determination result signal RSLT is "0".

In this instance, a nozzle for which the determination result signal RSLT is determined to be "1" is in a normal discharge state, and nozzles for which the determination result signal RSLT is determined to be "0" have the possibility of either the discharge failure state or the non-discharge state. In a case of deciding subsequent processing according to the determination result, since optimal recovery methods differ between the discharge failure state and the non-discharge state as described above, there is a possibility that recoverability is not sufficient, or excessive recovery processing is performed and ink is wastefully consumed.

For example, when the actual cause of the determination result signal RSLT "0" is discharge failure due to the attachment of an ink droplet to the discharge surface, the optimal recovery method is to wipe the discharge surface by blade wiping. However, since the determination result according to the conventional method suggests the possibility of the non-discharge state, it is necessary to select vacuum wiping or circulation processing for a predetermined amount of time. Here, when vacuum wiping is selected, there is no problem in recoverability from discharge failure due to ink adhered to the discharge surface, but there is a problem in that ink is excessively consumed. However, with a process for ink circulation for a predetermined amount of time, an ink droplet adhering to the discharge surface cannot be removed, so there is no recovery effect.

Thus, there are cases where conventional determination method cannot select the optimal process when performing processing in accordance with the determination result of discharge inspection. In the embodiments described below, an arrangement and control for solving such a problem will be described.

First Embodiment

Here, after describing an outline of a discharge determination process, an outline of a discharge determination process using a temperature detection element is explained with reference to a flow chart illustrated in FIG. 9, and processing for executing the optimum processing from a determination result signal when a discharge determination threshold is changed is explained with reference to the schematic views illustrated in FIG. 10A and FIG. 10B.

Figure 9:
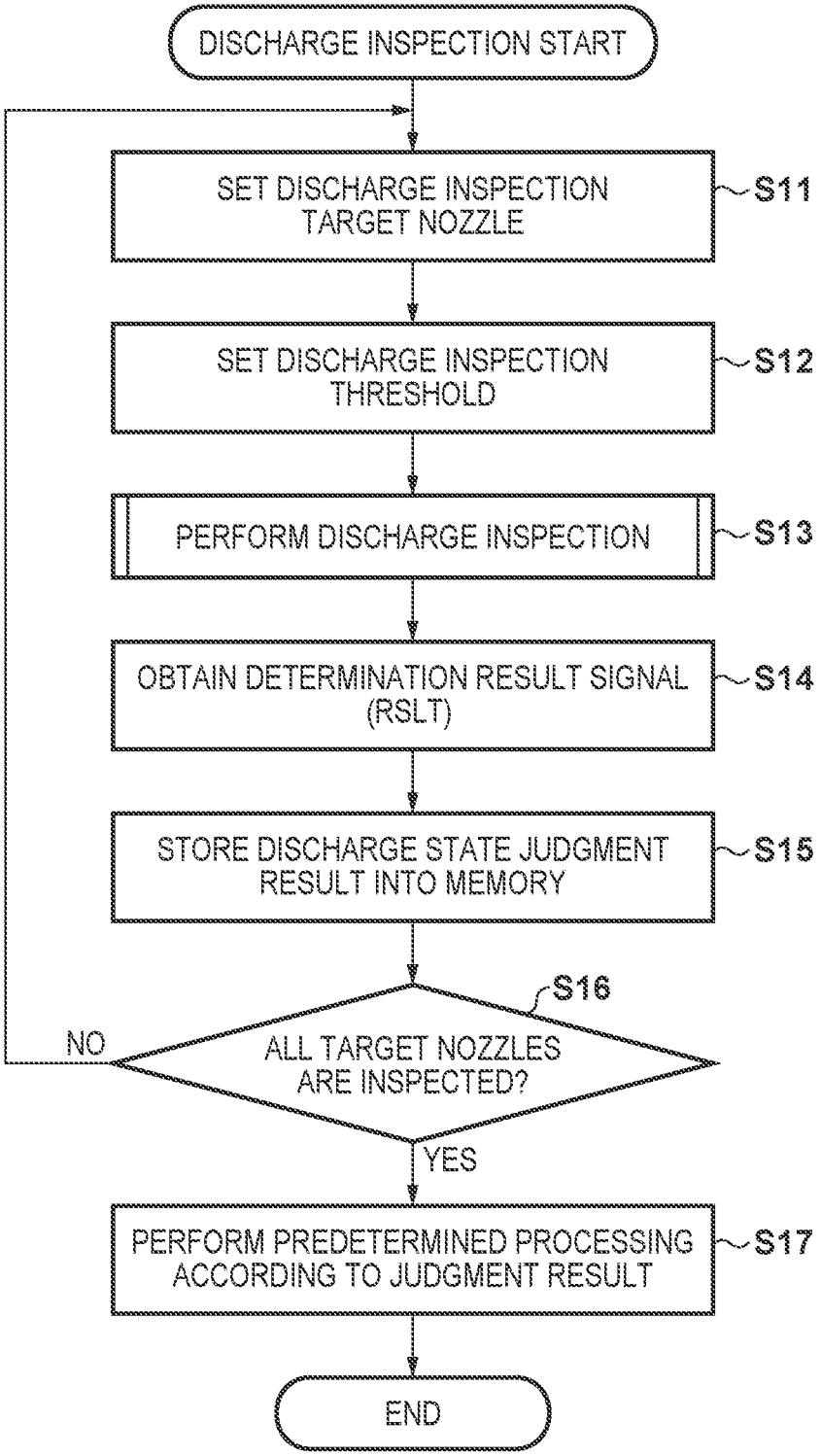
FIG. 9 is a flow chart illustrating an outline of a discharge determination process.

FIG. 9 is a flowchart illustrating an outline of a discharge inspection process using a temperature detection element.

The discharge inspection process illustrated in FIG. 9 is executed at any desired timing, and when the process is executed, the discharge state of each nozzle is determined. In this embodiment, a plurality of discharge inspection modes are provided, but the flow of processing is common thereamong.

First, in step S11, the print controller 419 makes an instruction for a nozzle (print element) that is to be an inspection target, and in accordance with this instruction, the signal generating unit 7 selects the inspection target nozzle in accordance with the sensor selection signal SDATA. Next, in step S12, the discharge inspection threshold voltage (TH) is set based on the present inspection result change point of the selected nozzle. The discharge inspection threshold voltage (TH) is set to a voltage lower by a predetermined amount than the peak value Dref of the temperature change signal of each nozzle at a time of normal discharge, which is held in advance. According to an arrangement in this embodiment, the discharge inspection threshold voltage can be set for each discharge inspection mode. A setting value of the discharge inspection threshold voltage for a respective discharge inspection mode will be described later.

Further, since the peak value Dref of the temperature change signal at the time of normal discharge may change according to the usage condition of the printing apparatus, it is desirable to update the temperature-change signal every predetermined timing. Predetermined timings includes a number of sheets fed, a number of printed dots, the time, an elapsed time period from a previous inspection, each print job, each printed page, a time of replacement of a printhead, a time of recovery processing of a printhead, and the like, and is appropriately set in accordance with the system.

In step S13, a discharge inspection is performed with the discharge inspection threshold voltage (TH) set for each of the discharge inspection modes. Then, in step S14, it is checked whether the determination result signal RSLT of the selected nozzle is "0" or "1". If the determination result signal RSLT is "1", there is a state where the peak value Dref of the temperature change signal at the time of normal discharge exceeds the discharge inspection threshold voltage (TH), and if the determination result signal RSLT is "0", there is a state where the peak value Dref falls below the discharge inspection threshold voltage (TH).

In step S15, the determination result signal RSLT of the selected nozzle is stored in the RAM 421.

Further, in step S16, it is checked whether or not inspection of all the target nozzles has finished. If it is determined that inspection is to continue, the process returns to step S11, another inspection target nozzle is selected, and the processes of step S12 and subsequent steps are executed. On the other hand, if it is determined that the inspection has been completed, the process proceeds to step S17, and recovery processing or the like corresponding to a respective discharge inspection mode is selected and executed in accordance with the determination result signal RSLT of each of the nozzles.

Next, with the schematic views illustrated in FIG. 10A to FIG. 10B, description will be given regarding the setting of the discharge determination threshold for each discharge inspection mode and discharge states that can be detected at that time. Here, two discharge inspection modes are described as an example, but there is no limitation to this, and the discharge inspection mode is appropriately set in accordance with the system.

Firstly, a first discharge inspection mode will be described.

The execution timing of the first discharge inspection mode is mainly set after completion of printing of one page or after completion of printing of a predetermined page during continuous page printing.

The purpose of executing this mode is:

to identify non-discharge nozzles and discharge failure nozzles that occurred during printing; and to perform complementary printing by replacing printing by a specific nozzle with printing by a normal nozzle, and if non-discharge or discharge failure nozzles occur to an extent that image correction by complementary printing is not sufficient, suspend printing and select and execute appropriate recovery processing.

Figure 10A:
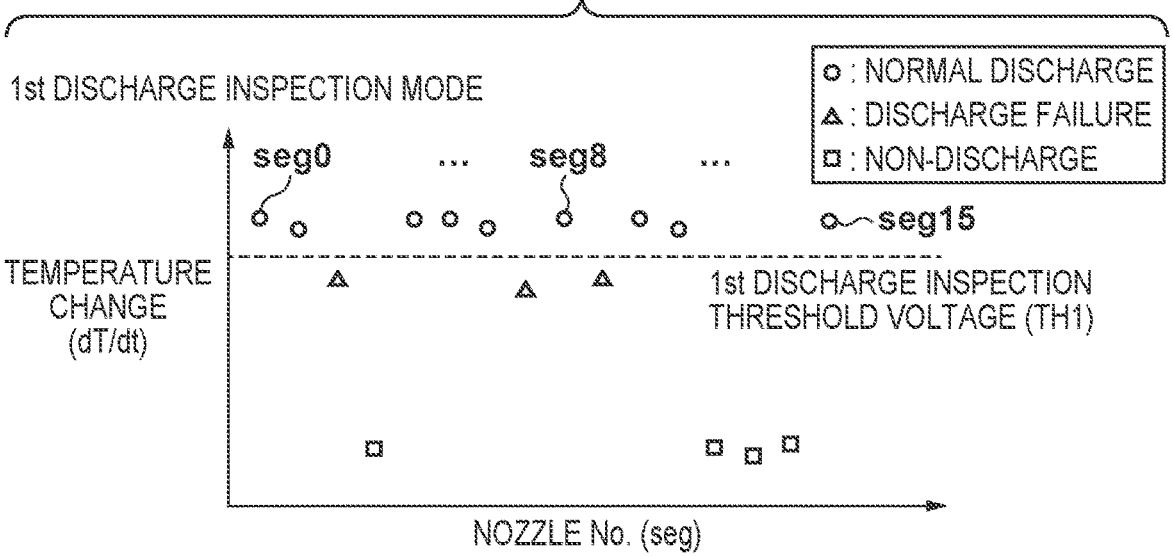
FIGS. 10A and 10B are views for explaining a determination process according to a first embodiment.

FIG. 10A illustrates a temperature change signal and a value of a determination result signal for each nozzle, when the first discharge inspection mode is executed. In this example, it is assumed that there is a situation where the printhead 3 has 16 nozzles (seg0 to seg15), and the discharge states of the nozzles are different from each other. As described above, since the temperature change signals detected differ in accordance with normal discharge, discharge failure due to ink adhered to the discharge surface, and non-discharge due to ink solidified in a nozzles, the discharge states of the respective nozzles are represented by ○: normal discharge, Δ: discharge failure, and □: non-discharge in FIG. 10A.

The discharge inspection threshold in the first discharge inspection mode is set to the first discharge inspection threshold (TH1) as illustrated in FIG. 10A, and thus the determination result signal RSLT of the normal discharge nozzles (○ in the drawing) above the first discharge inspection threshold becomes "1". Further, since the determination result signal RSLT of the discharge failure nozzle and non-discharge nozzle (Δ and □ in the drawing) below the first discharge inspection threshold is "0", discharge failure and non-discharge nozzles cannot be distinguished by the determination result signal. At this time, the first discharge inspection threshold (TH1) is set to a value −2 ranks lower than the average of the peak value Dref of the temperature change signal (dT/dt) at the time of normal discharge of the nozzles.

The purpose of the first discharge inspection mode is, as described above, to specify both discharge failure and non-discharge nozzles, which are causes of image quality degradation, and perform image correction by performing complementary printing using normal nozzles, and thus discharge failure nozzles and non-discharge nozzles do not need to be distinguished from each other. In addition, during a print operation, there is a high probability that ink droplets, paper dust originated from a print medium, and the like will adhere to the discharge surface and cause a discharge failure. Therefore, when non-discharge nozzles or discharge failure nozzles to an extent where image correction is not sufficient are detected, an optimal recovery method is to select and execute blade wiping.

Next, a second discharge inspection mode will be described.

The execution timing of the second discharge inspection mode is mainly at the time of recovery from a long-term unused state or an error state of the printing apparatus.

The purpose of execution of the second discharge inspection mode is to specify a non-discharge nozzle due to increased ink viscosity or ink adhesion in the nozzle, which may occur during a long-term unused state or during stoppage in an error state, and to select and execute appropriate recovery processing according to the number of nozzles specified.

Figure 10B:
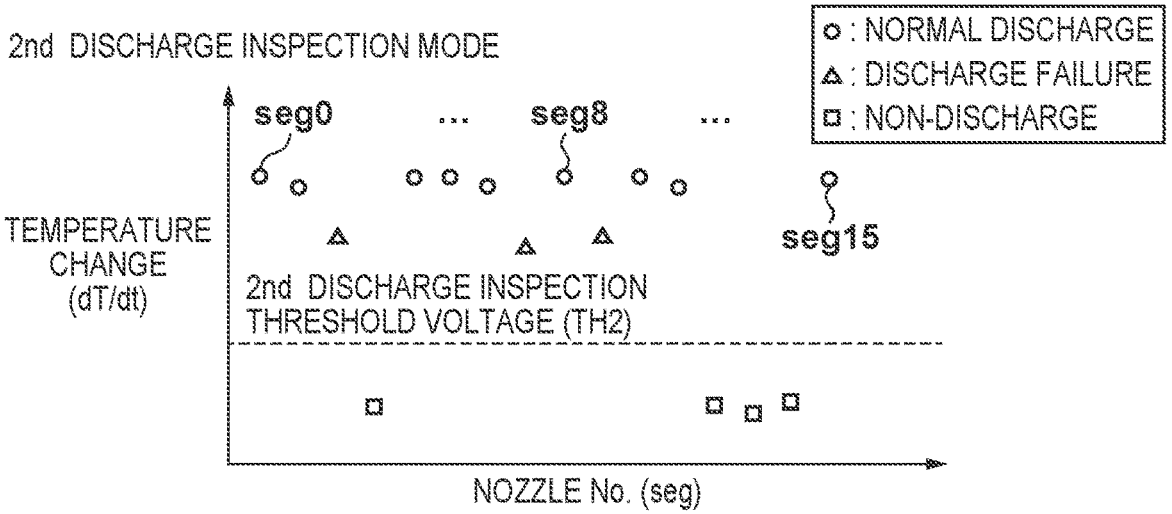

FIG. 10B illustrates a temperature change signal and a value of a determination result signal for each nozzle, when the second discharge inspection mode is executed. Note that the number of nozzles of the printhead and the meaning of symbols in FIG. 10B are similar to that described for FIG. 10A, and therefore, the description thereof is omitted.

The discharge inspection threshold in the second discharge inspection mode is set to the second discharge inspection threshold (TH2) as illustrated in FIG. 10B, and thus the determination result signal RSLT of the normal discharge nozzles and the discharge failure nozzles (○ and Δ in the drawing) above the second discharge inspection threshold becomes "1". Therefore, it is not possible to distinguish between normal discharge and discharge failure nozzles with the determination result signal. The determination result signals RSLT of the non-discharge nozzles (□ in the drawing) below the second discharge inspection threshold become "0". At this time, the second discharge inspection threshold is set to a value −5 ranks lower than the average of the peak value Dref of the temperature change signal (dT/dt) at the time of normal discharge of the nozzles. Therefore, the second discharge inspection threshold is a value that is smaller than the first discharge inspection threshold.

The purpose of the execution of the second discharge inspection mode is to select optimum recovery processing when the printing apparatus is returned from a long-term unused state or the error state, as described above. During an unused state, the volatile components of ink evaporate from the nozzles in accordance with the duration of the unused state, and the viscosity of ink in the nozzles increases or the ink solidifies, and therefore, in most cases, this is solved by continuing an ink circulation operation for a predetermined period. However, in a case where there is no prospect of recovery even if the ink circulation operation is continued for a predetermined period of time, it is determined that ink has completely solidified, and it is necessary to select another powerful recovery method such as vacuum wiping or charge suction. At this time, when nozzles in which ink droplets, paper dust originated from the print medium, and the like adhere to the discharge surface to cause discharge failure are included among nozzles for which the determination result signal RSLT is "0", a recovery method that involves ink consumption is selected irrespective of an ink circulation operation having no effect on the recovery of these nozzles. This leads to wasteful consumption of ink. Therefore, it is important to set the discharge determination threshold so that discharge failure nozzles are not included in determination of the determination result signal RSLT "0".

According to this embodiment, by providing a plurality of discharge inspection modes and setting a discharge inspection threshold for each discharge inspection mode, it is possible to detect a discharge state to be detected according to the purpose of discharge inspection, and therefore it is possible to select an appropriate handling process.

Note that arrangement may be taken such that the discharge inspection threshold set for each of the discharge inspection modes can be set for each nozzle group, and, for example, make it possible to vary discharge inspection threshold settings for nozzle arrays at the most upstream side and the most downstream side with respect to conveyance of a print medium for which a discharge failure is likely to occur.

Second Embodiment

In the first embodiment, description was given for an example in which a plurality of discharge detection modes are provided and processing in accordance with a discharge inspection threshold for each discharge detection mode and a result thereof is executed, but here, a method of estimating a discharge state for each nozzle based on results of a plurality of discharge detection modes will be described.

Figure 11:
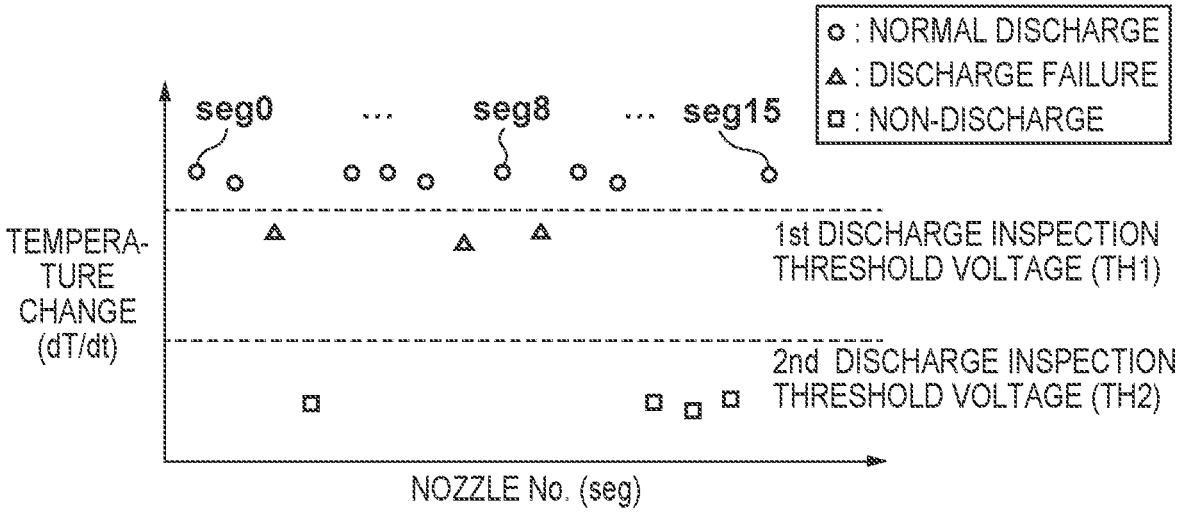
FIG. 11 is a view for explaining a determination process according to a second embodiment.

FIG. 11 is a view illustrating a relationship between temperature change point information and a discharge inspection threshold when the first discharge inspection mode and the second discharge inspection mode are executed at successive times, and the determination result signal RSLT. The meanings of the symbols and reference numerals used in the upper part of FIG. 11 are similar to those used in FIG. 10A and FIG. 10B, and therefore description thereof is omitted. Note that this arrangement may be set as a third discharge inspection mode as a mode having a plurality of discharge inspection thresholds.

The middle of FIG. 11 illustrates a list of the results of the determination result signal RSLT obtained from the relationship between the first discharge inspection threshold and the temperature change signal of each nozzle, and the determination result signal RSLT obtained from the relationship between the second discharge inspection threshold and the temperature change signal of each nozzle. As described in the first embodiment, it can be seen that the determination results are different because the discharge inspection threshold is different.

That is, in first discharge inspection mode, the normal discharge nozzles are classified as the determination result signal RSLT "1", and the discharge failure or non-discharge nozzles are classified as the determination result signal RSLT "0". That is, in second discharge inspection mode, the normal discharge nozzles or discharge failure nozzles are classified as the determination result signal RSLT "1", and non-discharge nozzles are classified as the determination result signal RSLT "0". Therefore, by combining these determination results, the discharge state of each nozzle can be specified in detail.

The lower part of FIG. 11 illustrates the discharge states of the nozzles determined by combinations of the determination result signals RSLT of the respective discharge inspection modes. In other words:

when the determination result signals RSLT in the first discharge inspection mode and second discharge inspection mode are both "1", normal discharge is determined for the nozzle;

when the determination result signals RSLT in the first discharge inspection mode and second discharge inspection mode are both "0", non-discharge is determined for the nozzle;

when the determination result signal RSLT in the first discharge inspection mode is "0" and the determination result signal RSLT in the second discharge inspection mode is "1", discharge failure is determined for the nozzle.

Therefore, in accordance with the embodiment described above, it is possible to specify the discharge state of each nozzle by making a determination that combines determination results of a plurality of discharge inspection modes. If it is possible to determine the discharge state for each nozzle, it is possible to execute an optimal recovery processing, such as selectively promoting recovery by increasing the number of times of driving for preliminary discharge with respect to a non-discharge nozzle, or optimizing the timing of blade wiping by counting the number of discharge failure nozzles. In this manner, it is possible to perform processing that is less wasteful in terms of both ink consumption and processing time, thereby realizing high-quality image printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-190314, filed Oct. 5, 2018, which is hereby incorporated by reference herein in its entirety.

What is claimed is:

1. A printing apparatus comprising:

a printhead provided with a plurality of nozzles for discharging liquid and a plurality of energy generating elements provided so as to correspond to the plurality of nozzles and each configured to generate energy for discharging liquid from the corresponding nozzle; and an inspection unit configured to:

(i) inspect a liquid discharge state for identifying nozzles of a first type at a first timing by selecting a nozzle to be a target for inspecting the liquid discharge state from the plurality of nozzles, by setting a first threshold for determining the liquid discharge state of the selected nozzle, and by driving the energy generating element corresponding to the selected nozzle, and (ii) inspect a liquid discharge state for identifying nozzles of a second type at a second timing different from the first timing by selecting a nozzle to be a target for inspecting the liquid discharge state from the plurality of nozzles, by setting a second threshold for determining the liquid discharge state of the selected nozzle, the second threshold being different from the first threshold, and by driving the energy generating element corresponding to the selected nozzle.

2. The apparatus according to claim 1, wherein by performing the inspection for identifying the nozzles of the first type, the inspection unit determines whether the selected nozzle is a nozzle of the first type or not, and by performing the inspection for identifying the nozzles of the second type, the inspection unit determines whether the selected nozzle is a nozzle of the second type or not.

3. The apparatus according to claim 2, wherein the inspection unit determines, as one of the nozzles of the first type, a nozzle that discharge liquid normally.

4. The apparatus according to claim 3, wherein the inspection unit does not determine, as one of the nozzles of the first type, a nozzle for which liquid discharge failure or for which liquid non-discharge has occurred.

5. The apparatus according to claim 3, wherein the inspection unit does not determine, as one of the nozzles of the first type, a nozzle from which liquid reaches a position shifted from an intended position on a printing medium or for which liquid non-discharge has occurred.

6. The apparatus according to claim 3, wherein the inspection unit does not determine, as one of the nozzles of the first type, a nozzle from which liquid is discharged with poor linearity or for which liquid non-discharge has occurred.

7. The apparatus according to claim 2, wherein the inspection unit determines, as one of the nozzles of the second type, a nozzle for which liquid non-discharge has occurred.

8. The apparatus according to claim 7, wherein
the inspection unit does not determine, as one of the nozzles of the second type, a nozzle that discharges liquid normally or for which liquid discharge failure has occurred.

9. The apparatus according to claim 1, further comprising a determination unit configured to determine the liquid discharge state of the selected nozzle based on a result of an inspection for identifying the nozzles of the first type performed by the inspection unit or an inspection for identifying the nozzles of the second type performed by the inspection unit.

10. The apparatus according to claim 9, wherein
by performing the inspection for identifying the nozzles of the first type, the liquid discharge state is determined by the determination unit by classifying between nozzles that discharge liquid normally, and nozzles for which liquid discharge failure or liquid non-discharge has occurred, and
by performing the inspection for identifying the nozzles of the second type, the liquid discharge state is determined by the determination unit by classifying between nozzles that discharge liquid normally or nozzles for which liquid discharge failure has occurred, and nozzles for which liquid non-discharge has occurred.

11. The apparatus according to claim 1, wherein the inspection unit performs the inspection for identifying the nozzles of the first type and the inspection for identifying the nozzles of the second type at successive timings, and
the apparatus further comprises a determination unit configured to determine a liquid discharge state for the selected nozzle based on an inspection result of an inspection identifying the nozzles of the first type by the inspection unit and an inspection result of an inspection identifying the nozzles of the second type by the inspection unit.

12. The apparatus according to claim 11, wherein
by performing the inspection for identifying the nozzles of the first type and the inspection for identifying the nozzles of the second type, the liquid discharge state is determined by the determination unit by classifying between nozzles that discharge liquid normally, nozzles for which liquid discharge failure has occurred, and nozzles for which liquid non-discharge has occurred.

13. The apparatus according to claim 1, further comprising a storage unit configured to store information indicating the liquid discharge state based on an inspection result of the inspection performed by the inspection unit.

14. The apparatus according to claim 1, further comprising a processing unit configured to maintain printing by the printhead based on an inspection result of the inspection performed by the inspection unit.

15. The apparatus according to claim 14, wherein
the inspection unit determines, as one of the nozzles of the first type, a nozzle that discharges liquid normally, and
the processing by the processing unit includes complementary printing by a nozzle that normally discharges liquid, and recovery processing that causes the liquid discharge state to recover.

16. The apparatus according to claim 15, wherein
the recovery processing includes performing at least one of preliminary discharge by the printhead, wiping of a discharge surface of the printhead, suction of a nozzle of the printhead, and liquid circulation between the printhead and a liquid tank for supplying ink to the printhead.

17. The apparatus according to claim 1, wherein
the first or second threshold can be set for each of the plurality of nozzles or for any group of nozzles.

18. The apparatus according to claim 1, wherein
the first timing includes after printing of one page of a print medium finishes or after printing of a predetermined number of pages during continuous page printing on print media finishes, and
the second timing includes a timing when the printing apparatus returns from a long-term unused state or an error state.

19. The apparatus according to claim 1, wherein
the inspection unit includes:
a signal generation unit configured to generate a selection signal for selecting, from the plurality of nozzles, a nozzle to be the target for inspecting a liquid discharge state and an inspection threshold signal indicating the first or second threshold, and to output the selection signal and the inspection threshold signal to the printhead; and
an instruction unit configured to issue an instruction to cause a nozzle indicated by the selection signal generated by the signal generation unit and the first or second threshold indicated by the inspection threshold signal to change.

20. The apparatus according to claim 19, wherein
the instruction unit issues an instruction for the inspection unit to set nozzles to have as inspection targets one by one.

21. The apparatus according to claim 1, wherein
the inspection unit inspects the liquid discharge state by driving the selected energy generating element by applying a pulse for discharging the liquid from the corresponding nozzle.

22. The apparatus according to claim 1, wherein
the inspection unit detects a temperature waveform signal indicating a temperature of the printhead.

23. The apparatus according to claim 1, wherein
the inspection unit inspects the liquid discharge state by comparing a temperature change signal based on the temperature waveform signal with the set first or second threshold.

24. The apparatus according to claim 1, further comprising a suction unit configured to suck liquid from the nozzles of the printhead, wherein
in a case in which a nozzle is identified as the second type based on a result of the inspection for identifying the nozzles of the second type, the suction unit sucks the liquid from the identified nozzle.

25. The apparatus according to claim 1, further comprising a circulation unit configured to circulate liquid between the printhead and a liquid tank for supplying liquid to the printhead, wherein
in a case in which a nozzle is identified as the second type based on a result of the inspection for identifying the nozzles of the second type, the circulation unit circulates the liquid between the printhead and the liquid tank.

26. The apparatus according to claim 1, further comprising:
a processing unit configured to perform complementary printing using a nozzle that normally discharges liquid, wherein
in a case in which a nozzle is identified as the second type based on a result of the inspection for identifying the nozzles of the second type, the processing unit performs the complementary printing.

27. A method of controlling a printing apparatus operable to print on a print medium using a printhead provided with a plurality of nozzles for discharging liquid and a plurality of energy generating elements provided so as to correspond to the plurality of nozzles and each configured to generate energy for discharging liquid from the corresponding nozzle, the method comprising:

inspecting a liquid discharge state for identifying nozzles of a first type at a first timing by:

selecting a nozzle to be a target for inspecting the liquid discharge state from the plurality of nozzles, setting a first threshold for determining the liquid discharge state of the selected nozzle, and driving the energy generating element corresponding to the selected nozzle; and inspecting a liquid discharge state for identifying nozzles of a second type at a second timing different from the first timing by:

selecting a nozzle to be a target for inspecting the liquid discharge state from the plurality of nozzles, setting a second threshold for determining a discharge state of the selected nozzle, the second threshold being different from the first threshold, and driving the energy generating element corresponding to the selected nozzle.

28. The method according to claim 27, wherein by performing the inspection for identifying the nozzles of the first type, whether the selected nozzle is a nozzle of the first type or not is determined, and by performing the inspection for identifying the nozzles of the second type, whether the selected nozzle is a nozzle of the second type or not is determined.

29. The method according to claim 28, wherein a nozzle that discharges liquid normally is determined as one of the nozzles of the first type.

30. The method according to claim 29, wherein a nozzle for which liquid discharge failure has occurred or for which liquid non-discharge has occurred is not determined as one of the nozzles of the first type.

31. The method according to claim 29, wherein a nozzle from which liquid reaches a position shifted from an intended position on a printing medium or for which liquid non-discharge has occurred is not determined as one of the nozzles of the first type.

32. The method according to claim 29, wherein a nozzle from which liquid is discharged with poor linearity or for which liquid non-discharge has occurred is not determined as one of the nozzles of the first type.

33. The method according to claim 28, wherein a nozzle for which liquid non-discharge has occurred is determined as one of the nozzles of the second type.

34. The method according to claim 33, wherein a nozzle that discharges liquid normally or for which liquid discharge failure has occurred is not determined as one of the nozzles of the second type.

35. The method according to claim 27, further comprising determining the liquid discharge state of the selected nozzle based on a result of an inspection for identifying the nozzles of the first type or an inspection for identifying the nozzles of the second type.

* * * * *